US007621535B2

(12) United States Patent
Spivey

(10) Patent No.: US 7,621,535 B2
(45) Date of Patent: Nov. 24, 2009

(54) METHOD OF PLAYING A COMBINATION OF THREE CARD POKER AND DRAW POKER

(76) Inventor: George Talmadge O'Neal Spivey, 303 Perry Works Rd., Attalla, AL (US) 35954

( * ) Notice: Subject to any disclaimer, the term of this patent is extended or adjusted under 35 U.S.C. 154(b) by 0 days.

(21) Appl. No.: 11/821,799

(22) Filed: Jun. 26, 2007

(65) Prior Publication Data

US 2009/0001666 A1 Jan. 1, 2009

(51) Int. Cl.
*A63F 1/00* (2006.01)

(52) U.S. Cl. ..... 273/292

(58) Field of Classification Search ..... None
See application file for complete search history.

(56) References Cited

U.S. PATENT DOCUMENTS

| | | | | |
|---|---|---|---|---|
| 5,224,706 | A | 7/1993 | Bridgeman et al. | |
| 5,597,162 | A | 1/1997 | Franklin | |
| 5,685,774 | A | 11/1997 | Webb | |
| 5,702,104 | A | 12/1997 | Malek et al. | |
| 6,012,719 | A | 1/2000 | Webb | |
| 6,533,279 | B2 | 3/2003 | Moody et al. | |
| 6,543,773 | B2 | 4/2003 | Mims | |
| 6,698,759 | B2 | 3/2004 | Webb et al. | |
| 6,705,943 | B2 | 3/2004 | Awada | |
| 7,175,522 | B2 | 2/2007 | Hartl | |
| 2004/0036219 | A1 * | 2/2004 | Schibetta | 273/292 |
| 2004/0217548 | A1 * | 11/2004 | Snow | 273/292 |
| 2007/0102882 | A1 * | 5/2007 | Snow | 273/292 |
| 2008/0026812 | A1 * | 1/2008 | Smith et al. | 463/18 |
| 2008/0073844 | A1 * | 3/2008 | Shackleford | 273/292 |

FOREIGN PATENT DOCUMENTS

| | | | |
|---|---|---|---|
| CA | 2249869 | A1 | 12/1999 |
| WO | 01/43840 | A2 | 6/2001 |

* cited by examiner

*Primary Examiner*—Gene Kim
*Assistant Examiner*—Dolores Collins
(74) *Attorney, Agent, or Firm*—Ann I. Dennen; Lanier Ford Shaver & Payne P.C.

(57) ABSTRACT

A method for playing a combination of Three Card Poker® and Draw Poker. One to seven people can play against the dealer. Each player places a wager on ante and pairplus (optional) and is dealt three cards face down and the dealer four cards face down. Each player has the option to discard one card and receive another by placing a wager equal to ante on the draw card space. If the player bets only pairplus he cannot receive a draw card. If the player decides to play he must place wager (equal to ante) on play space or fold and forfeit all wagers. The dealer then flips his four cards, discards one card to make his best three card hand. Dealer plays with Queen high or better. Dealer checks each played hand. Payouts are then determined based on the paytable and the amount the player wagered.

5 Claims, 2 Drawing Sheets

METHOD OF PLAYING A COMBINATION OF THREE CARD POKER AND DRAW POKER

BACKGROUND OF THE INVENTION

1. Field of the Invention

This invention relates to casino style table games.

2. Description of Related Art

Poker has became popular around the world. There has also been a huge interest in games that are not so complicated and played rapidly like Three Card Poker® U.S. Pat. No. 5,685,774. In this game a player places his/her bet on (the Ante area) to play against the dealer's hand and/or the player makes a second bet in (the PAIR PLUS area) to play hand value of his/her cards or the player makes both bets.

This game is played with a standard deck of playing cards (52 cards), three cards are dealt to the player and three cards are dealt to the dealer. When player bets Ante he/she must now bet in (Play area) or fold and forfeit all bets. If the player bets, he/she plays the three card hand against the dealers hand.

If the dealer does not play (dealer must have Queen High or better to qualify) the player wins 1 to 1 odds on the Ante bet and pushes on the Play bet. If the dealer has Queen High or better hand the dealer qualifies to play. If the players hand beats the dealer, player wins 1 to 1 odds on both Ante and Play bets. If the dealer and the player tie it's a push, Ante and Play bets are returned to the player. With the Pair Plus bet only the players hand is used and he/she wins if he/she has a pair or better.

Odds are as follows.

Pair (1 to 1)
Flush (4 to 1)
Straight (6 to 1)
Three of a Kind (30 to 1)
Straight Flush (40 to 1)

You may also play Pair Plus only without playing Ante or Play. In Three Card Poker® if the player receives a bad hand, he/she has no chance to improve their hand.

SUMMARY OF THE INVENTION

This present invention is an improved card game for casinos that combines the well known games of Three Card Poker® and Draw Poker. The game will pay players according to the odds posted based upon the rank of the cards of each player that plays.

This present invention is played between the dealer who represents a banker, such as a casino employee and one up to seven players. This game is started by a player placing a bet on ANTE and PAIR PLUS (optional) to play against the dealer or the house. The dealer then deals three cards face down to each player and deals four cards face down to him or herself. The dealer then pushes the cards to each player allowing them to look at their hand during which time they decide whether to play, fold or draw.

In this invention the player has the option of drawing another card by discarding one card in the DRAW CARD area with a bet (bet must match ANTE) on top of the card. The dealer takes the card and bet and replaces it with a new card. The player then adds the new card to his/her hand where he/she then makes the decision to play or fold. If the player decides to play the hand he/she must place bet on PLAY area (bet must match ANTE). If the player bets only Pair Plus he/she can not discard a card and receive another. If he/she decides to fold all bets are forfeited.

After all the plays have been made the dealer turns over his/her four cards discarding one to make their best three card hand. The dealer plays with Queen High or better. Pay outs are then determined for each player based on the pay table and the amount the player wagered. The pay table is as follows.

Against The Dealer

If the dealer does not play Ante wins 1 to 1. If the dealer plays and the players hand beats the dealer, Play wins 1 to 1 and Ante wins 1 to 1. If the dealer and players hand ties wagers are returned.

Ante Bonus Wins Extra Bonus Payouts

Following hands are always paid extra BONUS on ANTE as BONUS does not play against dealer.

| | | |
|---|---|---|
| Straight | 3 in sequence unsuited | 1 to 1 |
| Three of a kind | 3 of same kind | 3 to 1 |
| Straight Flush | 3 in sequence suited | 4 to 1 |

PAIRPLUS Win Payouts

| | | |
|---|---|---|
| Pair | 2 of same kind | 1 to 1 |
| Flush | 3 suited | 3 to 1 |
| Straight | 3 in sequence unsuited | 5 to 1 |
| Three of a kind | 3 of same kind | 20 to 1 |
| Straight Flush | 3 in sequence suited | 30 to 1 |

DETAILED DESCRIPTION OF THE INVENTION

Figure 1:
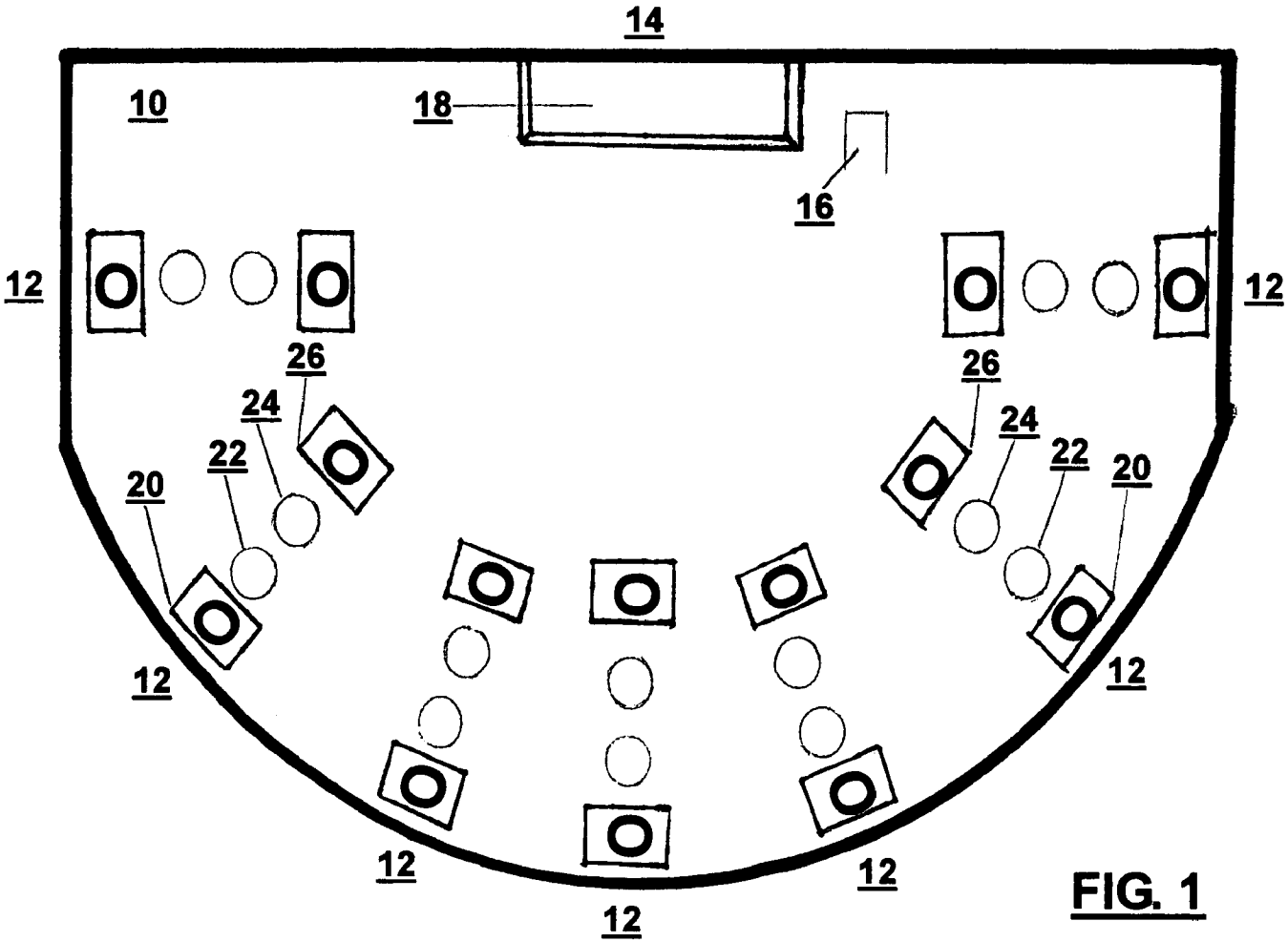
FIG. 1 shows an illustrated layout of the gaming table on which the present invention can be played.
Figure 2:
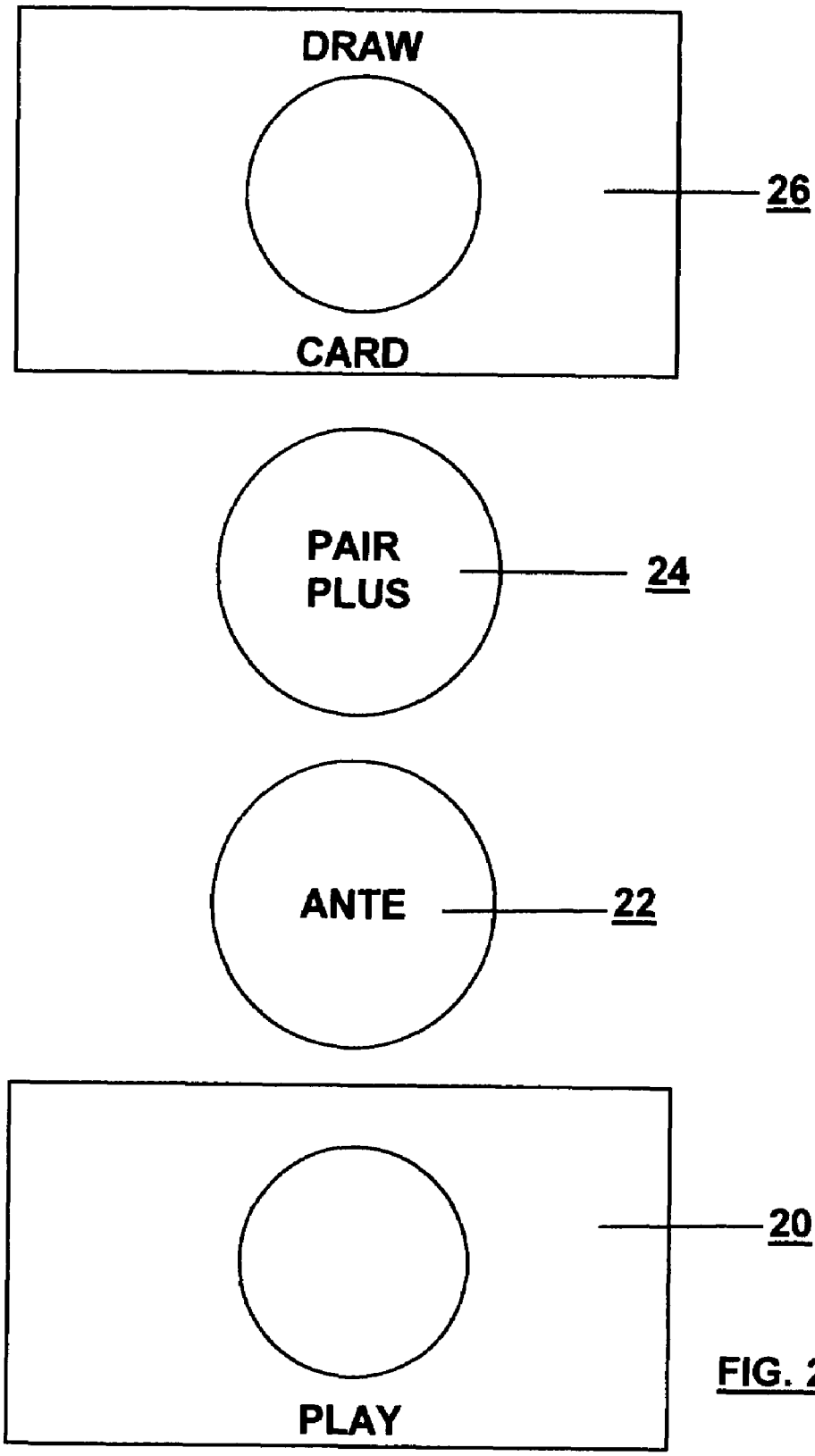
FIG. 2 shows an enlarged view of the wagering area.

FIG. 1 shows an illustrated layout of the gaming table on which the present invention can be played. Which includes a plurality of player locations 12 not to exceed seven, and a dealer location 14.

The present invention is a card game that is played with a standard physical deck of playing cards (52 cards). Each player's location 12 has a designated location 22 for "ANTE" wager and a designated location 24 for "PAIRPLUS" wager and a designated location 26 for "DRAW CARD" wager and a designated location 20 for "PLAY" wager.

Each player places a wager on location 22 and a wager on location 24 (optional). The dealer deals each player three cards face down, and him/herself four cards face down. Each player must decide to play, fold or draw. If playing their hand, he/she must place their cards face down with a wager on top in the designated location 20. If the player decides to fold, cards must be placed face down and pushed toward dealer forfeiting all wagers. Each player has the option to discard one card, they must place that card face down with wager equal to ante on top in location 26. The dealer pulls the discard and places it in a designated location 16 "discard shoe" and the wager in a designated location 18 the dealer's chip/token rack. The player's card is replaced face down in location 26. The player adds the new card to his/her hand making a final decision to play or fold and forfeit all wagers as described above.

The dealer continues clockwise to the next player. After each player has made their decision, the dealer turns his four cards face up and discards one card to make his/her best three card hand. The dealer's discard is placed in location 16.

The dealer's three card hand must be Queen high or better to play. The dealer starts with the first player to his/her left that plays and compares his/her three card hand against the dealer's three card hand. If the player's three card hand is higher rank than the dealers three card hand, the player's winnings are determined by what the player wagered and is paid from location 18 according to the paytable.

Hands are ranked according to the following:

Highest:

Straight Flush: three cards of one suit in sequence
Three of a kind: three cards of one kind
Straight: three cards unsuited in sequence
Flush: three cards of one suit
Pair: two cards of same kind Lowest:

High Card:
A-K-J unsuited and so on, until
5-3-2 unsuited lowest ranking
ACE is high except in 3-2-A sequence
Paytable is as follows:

Bet:

Bet ante to play against the dealer, or bet pairplus to play hand value or bet both. Stakes can be different on pairplus and ante.

Deal:

Each player and dealer plays with a three card poker hand.

Draw Card:

Each player may discard one card in exchange for a draw card (opt). To receive the draw card, players must place the discard in the draw card area with the wager on top (wager must equal ante). If a player plays PairPlus only he/she cannot receive draw card.

Against Dealer:

Player—Bet play exactly equal to ante, draw (opt) or fold and surrender all wagers.

Dealer—The dealer is dealt four cards face down, after everyone plays, draws, or folds, the dealer will discard one card to make the best three card hand. The dealer plays with Queen high or better.

Against Dealer Payouts:

If dealer does not play ante wins 1 to 1. If dealer plays and if players hand beats the dealers hand, play wins 1 to 1 and Ante wins 1 to 1, ties stakes are returned.

Ante Bonus Wins Extra Payouts:

The hands are always paid extra bonus on Ante as bonus does not play against dealer.

| | | |
|---|---|---|
| 3 cards in sequence | straight | 1 to 1 |
| 3 cards of same kind | 3 of a kind | 3 to 1 |
| 3 cards in sequence suited | straight flush | 4 to 1 |

Pairplus Win Payouts:

| | | |
|---|---|---|
| Pair | 2 of a kind | 1 to 1 |
| Flush | 3 suited | 3 to 1 |
| Straight | 3 in sequence unsuited | 5 to 1 |
| 3 of a kind | 3 of same kind | 20 to 1 |
| Straight Flush | 3 in sequence suited | 30 to 1 |

Winning Pairplus hand must always bet play if also playing against dealer. Ace is high except in 3-2-Ace sequence.

The preferred embodiment of the present invention has been described in context of live casino table game. This present invention provides a game which combines the aspects of Three Card Poker® and Draw Poker and maintains a reasonable odds for the casino.

Although not specifically shown in the drawing figures, the game of the present invention may also be played electronically.

While the invention has been particularly shown and described with reference to several embodiments thereof, it will be understood by those skilled in the relevant art that various changes in form and details may be made therein without departing from the spirit and scope of the invention as defined in the appended claims.

I claim:

1. A method of playing a poker-style card game, the method comprising:

at least one player placing an initial wager to participate in the game, thereby forming a wagered player;

dealing a first number of cards from a physical deck of playing cards face down to the wagered player;

dealing a second number of cards from a physical deck of playing cards face down to the dealer to form a dealer's hand, the wagered player discarding a card if the wagered player places an additional wager;

dealing the wagered player a replacement card for the discarded card if the wagered player discarded one of the first number of cards from a physical deck of playing cards;

discarding one card from the dealer's hand; and resolving the wagered player's wager based on the initial number of cards dealt and a predetermined payout schedule, wherein the wagered player discarding and the dealing of the replacement card occur only when the player places the additional wager.

2. The method of claim 1, wherein the first number of cards is three.

3. The method of claim 1, wherein the first number of cards is equal to the number of cards needed to determine a winning poker hand.

4. The method of claim 3, wherein the second number of cards is equal to one more than the first number of cards.

5. The method of claim 1, wherein the additional wager is greater than or equal to the initial wager.

* * * * *